US005881029A

United States Patent [19]

Kuo

[11] Patent Number: 5,881,029

[45] Date of Patent: Mar. 9, 1999

[54] DEVICE TO TRIGGER BUZZING OF ALARM CLOCK

[76] Inventor: Chu-Rong Kuo, 12F, No. 367, Han Kou Road, Sec. 4, Taichung, Taiwan

[21] Appl. No.: 52,987

[22] Filed: Apr. 1, 1998

[51] Int. Cl.[6] ..... G04B 23/00

[52] U.S. Cl. ..... 368/262; 368/264

[58] Field of Search ..... 368/313, 316, 368/257, 262, 265, 72

[56] References Cited

U.S. PATENT DOCUMENTS

| | | | |
|---|---|---|---|
| 1,381,225 | 6/1921 | Pfeifer, Jr. | 368/262 |
| 4,747,087 | 5/1988 | Sakuma | 368/262 |
| 5,050,140 | 9/1991 | Aubert | 368/73 |
| 5,365,499 | 11/1994 | Sell | 368/262 |
| 5,757,732 | 5/1998 | Kuo | 368/262 |

*Primary Examiner*—Bernard Roskoski
*Attorney, Agent, or Firm*—Browdy and Neimark

[57] ABSTRACT

An alarm clock has a housing provided with a control door having a permanent magnet and an actuating rod capable of pushing a conductive elastic piece located in the housing. The conductive elastic piece is capable of actuating a magnetic sensor which is located in the housing and is composed of an electromagnet and a relay capable of altering the polarity of the electromagnet to attract the permanent magnet of the control door. The magnetic sensor is actuated by the control circuit of the alarm clock at a desired time set to buzz such that the polarity of the electromagnet is changed by the relay, and that the control door is thus repelled to remain open.

6 Claims, 3 Drawing Sheets

DEVICE TO TRIGGER BUZZING OF ALARM CLOCK

FIELD OF THE INVENTION

The present invention relates generally to an alarm clock, and more particularly to a buzzing device of the alarm clock.

BACKGROUND OF THE INVENTION

The effect of the conventional alarm clock is generally attained by mechanical method consisting of a spring and a hammer, or an electronic method consisting of a quartz oscillator. The housing of the conventional alarm clock is provided with a press device for controlling or stopping the buzzing or the ringing of the alarm clock. Such a conventional alarm clock, either mechanical alarm clock or electronic alarm clock, as described above is not dynamically attractive to the sophisticated consumers.

SUMMARY OF THE INVENTION

The primary objective of the present invention is therefore to provide an alarm clock with an improved buzzing device which is simple and compact in construction, and versatile in design.

In keeping with the principle of the present invention, the foregoing objective of the present invention is attained by an alarm clock consisting of a main body, a battery set, a speaker, a control circuit, and a housing which is provided with a control door fastened pivotally therewith. The control door is provided with a permanent magnet and an actuating rod. The housing is provided therein with a magnetic sensor opposite in location to the permanent magnet. The magnetic sensor is composed of an electromagnet and a relay capable of being actuated by the control circuit to alter the magnetic pole of the electromagnet. The housing is further provided with a conductive elastic piece and a contact piece capable of being triggered by the conductive elastic piece to actuate the magnetic sensor to bring about a polarity opposite to the polarity of the permanent magnet, thereby causing the control door to remain in an "OFF" state. The control circuit is triggered at any designated time to actuate the magnetic sensor to bring about the polarity corresponding to the permanent magnet, thereby causing the control door to remain in an "ON" state to bring about the buzzing effect.

The foregoing objective, features, functions, and advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
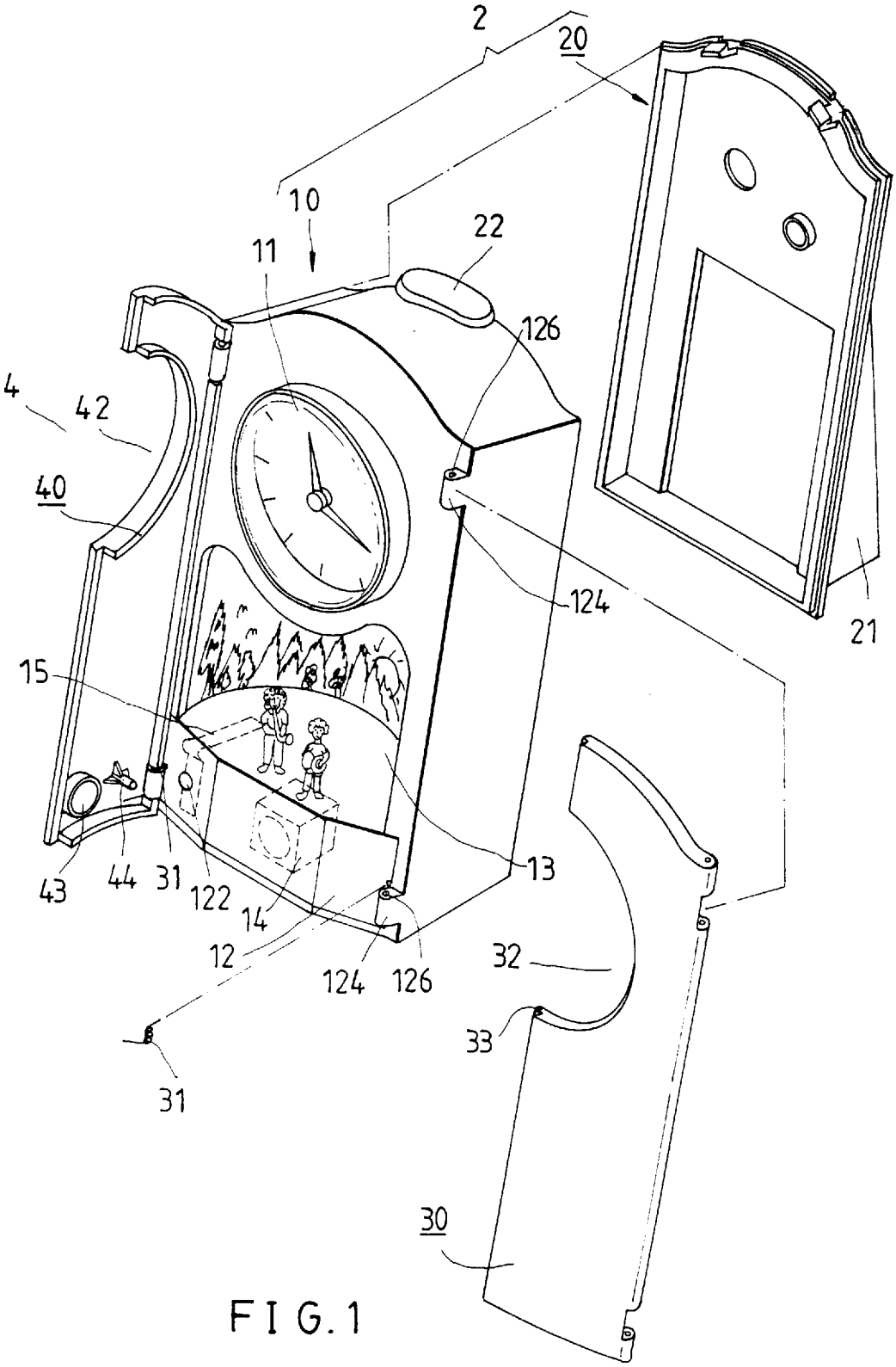
FIG. 1 shows an exploded view of a first preferred embodiment of the present invention.
Figure 2:
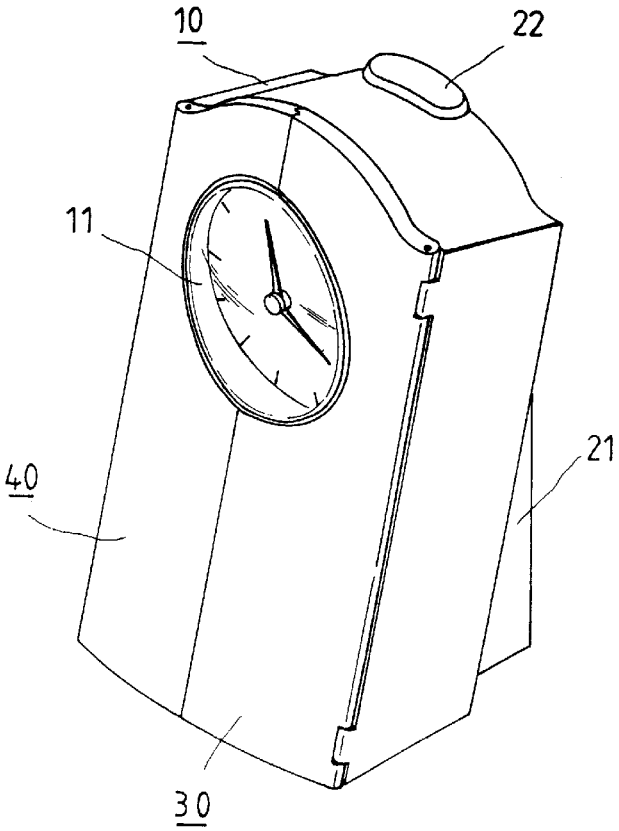
FIG. 2 shows a perspective view of the first preferred embodiment of the present invention in combination.

As shown in FIGS. 1 and 2, an alarm clock embodied in the present invention is mainly composed of a housing 2 and a device 4 to trigger buzzing.

Figure 3:
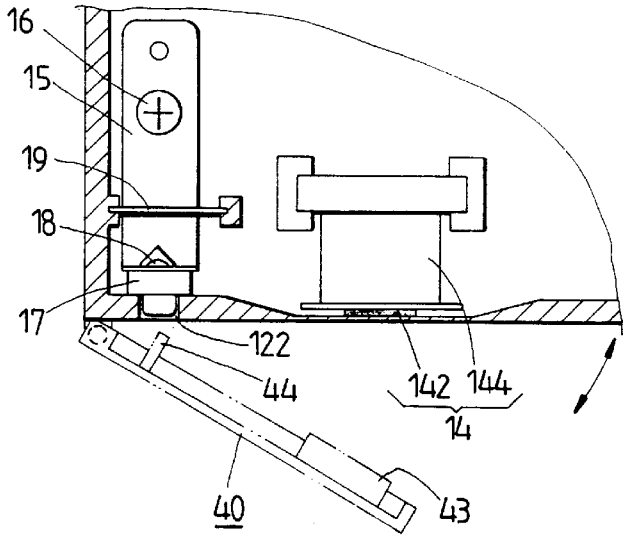
FIG. 3 shows a sectional view of a portion taken along the direction indicated by a line 3—3 as shown in FIG. 2.
Figure 4:
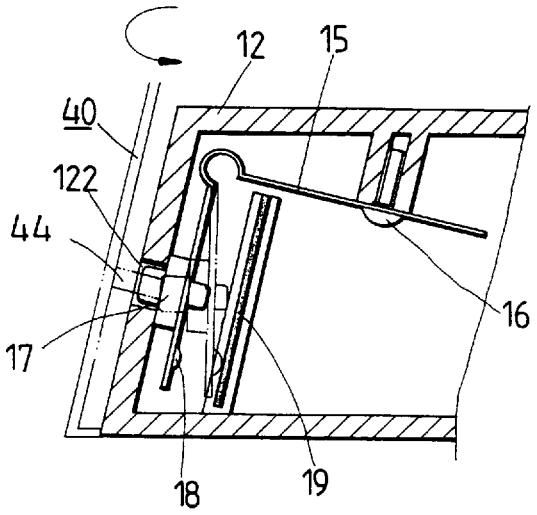
FIG. 4 shows a sectional view of a portion taken along the direction indicated by a line 4—4 as show in FIG. 2.

The housing 2 is made up of a front housing body 10 and a rear housing body 20. The front housing body 10 contains a main body 11 of the alarm clock. The front housing body 10 is provided at the bottom end thereof with a stepped portion 12 of an appropriate height. Located between the stepped portion 12 and the main body 11 is a recess 13. As shown in FIGS. 3 and 4, a magnetic sensor 14 is located in the stepped portion 12. The magnetic sensor 14 is composed of an electromagnet 142 and a relay 144. The electromagnet 142 is fastened with the relay 144 which is capable of controlling and changing the direction of flow of the magnetoelectric current so as to alter the N/S magnetic pole of the electromagnet 142. The magnetic sensor 14 is provided with an L-shaped conductive elastic piece 15, which is fastened at one end thereof with the stepped portion 12 by means of a screw 16. A triggering rod 17 is retained by another end of the conductive elastic piece 15 such that one end of the triggering rod 17 is received in a through hole 122 of the stepped portion 12. The triggering rod 17 is provided with a contact protuberance 18 which is in turn provided with a contact piece 19 fastened therewith such that the contact piece 19 is capable of actuating the relay 144 to generate a reverse current at such time when the contact protuberance 18 is forced to bend to make contact with the contact piece 19. In the meantime, the polarity of the electromagnet 142 is changed. The front housing 10 is further provided at the top end thereof with a shut-off switch 22 which is intended to facilitate the interrupting of the buzzing effect. The front housing 10 is still further provided with a speaker, a chip and a control circuit, which are not shown in the drawings and are involved in the buzzing effect. The front housing 10 is still further provided with two pivoting lugs 124, which are respectively located at a juncture of two side edges and a front edge of the front housing 10. Each of the two pivoting lugs 124 is provided with an axial hole 126.

The rear housing 20 is fastened with the rear side of the front housing 10 and is provided with a battery cell 21 for locating batteries to provide the main body 11 with the power source.

The triggering device 4 is fastened with a front side of the front housing 10 and is composed of a right door 30 and a left door 40. The right door 30 is fastened pivotally with the two pivoting lugs 124 of one of two side edges of the front housing 10 by means of two springs 31 and is provided with a semicircular recessed portion 32 corresponding in location to the main body 11 and having a protruded edge 33. The left door 40 is fastened pivotally with the two pivoting lugs 124 of another one of the two side edges of the front housing 10 by means of two springs 41, as shown in FIG. 1. The right door 30 and the left door 40 can be kept partially open by the elastic force of the springs 31. The left door 40 is provided with an arcuate recess 42 corresponding in location to the main body 11, and a permanent magnet 43 fastened to the inner side of the bottom of the left door 40 such that the permanent magnet 43 corresponding in location to the magnetic sensor 14. The left door 40 is further provided in the inner side of the bottom thereof with an actuating rod 44 fastened thereto such that the actuating rod 44 is corresponding in location to the through hole 122 of the stepped portion 12.

The right door 30 and the left door 40 of the front housing 10 remain partially open by the elastic forces of the springs 31 and 41. As the doors 30 and 40 are closed, the triggering rod 17 is urged by the actuating rod 44 to cause the conductive elastic piece 15 to swivel, as indicated by the imaginary lines in FIG. 4, such that the contact protuberance 18 of the conductive elastic piece 15 is in contact with the contact piece 19 of the front housing 10, and that the relay 144 is thus actuated to generate a magnetoelectric current to alter the magnetic poles of the electromagnet 142. In other words, the electromagnet 142 is caused to bring about a magnetic pole opposite to the magnetic pole of the permanent magnet 43 of the left door 40. As a result, an attractive force is brought about such that the attractive force is greater than the elastic forces of the springs 31 and 41, and that the doors 30 and 40 remain closed.

As the time that is set to buzz is up, the control circuit in the front housing 10 is triggered to actuate the relay 144 of the magnetic sensor 14 to generate a reverse magnetoelectric current. In other words, the electromagnet 142 is caused to bring about the polarity corresponding to the polarity of the permanent magnet 43. As a result, the permanent magnet 43 and the electromagnet 142 repel each other. In the absence of the attractive force, the elastic forces of the springs 31 and 41 are at work to keep the doors 30 and 40 open. In the meantime, the control circuit and the speaker of the main body 11 are also at work to bring about the buzzing. The buzzing can be terminated by closing the doors 30 and 40 to actuate the electromagnet 142 of the magnetic sensor 14 so as to bring about the attractive force, as described above. When the triggering rod 17 is in contact with the contact piece 19, the control circuit, the chip and others of the main body 11 are also at work to stop the buzzing.

Figure 5:
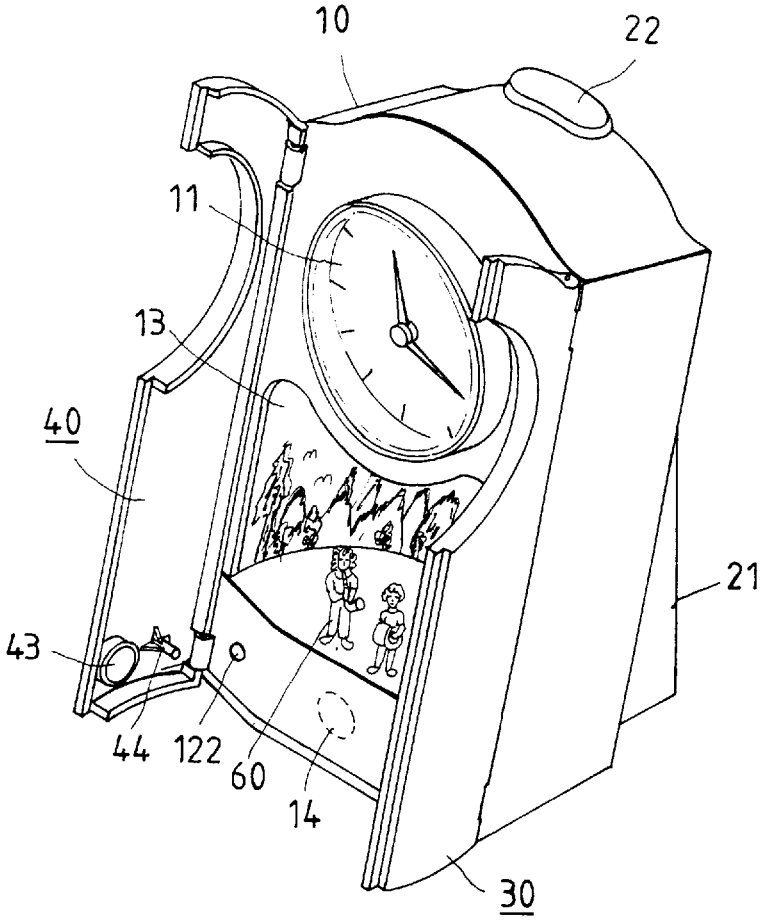
FIG. 5 shows a perspective view of a second preferred embodiment of the present invention.

As shown in FIG. 5, the present invention is decorated with a plurality of toy musicians 60 located on the stepped portion 12 of the front housing 10. In addition, the present invention is provided with a plurality of LED (light-emitting diode) bulbs which are located in the recess 13 of the front housing and are capable of flashing at the time when the buzzing begins. The stepped portion 12 of the present invention looks like a miniature stage.

What is claimed is:

1. An alarm clock comprising a housing containing an alarm clock main body, a battery set, a speaker, and a control circuit; wherein said housing is provided in front of a dial face of the alarm clock main body with at least one control door fastened pivotally therewith, said control door provided with a permanent magnet and an actuating rod fastened therewith such that said permanent magnet is corresponding in location to a magnetic sensor which is located in said housing and is composed of an electromagnet and a relay capable of being actuated by the control circuit to alter magnetic polarity of said electromagnet, and that said actuating rod is corresponding in location to a conductive elastic piece located in said housing, said conductive elastic piece capable of making contact with a contact piece located in said housing to actuate said magnetic sensor at the time when said conductive elastic piece is pushed by said actuating rod, thereby resulting in an alteration in magnetic polarity of said electromagnet such that said permanent magnet of said control door is attracted to said electromagnet, said magnetic sensor capable of being actuated by the control circuit at a desired buzzing time such that magnetic polarity of said electromagnet is once again altered by said relay, and that said permanent magnet of said control door is repelled by said electromagnet.

2. The alarm clock as defined in claim 1, wherein said control door is fastened with said housing by at least two springs for providing said control door with an elastic force enabling said control door to remain open at such time when said permanent magnet of said control door is not in contact with said magnetic sensor.

3. The alarm clock as defined in claim 1, wherein said housing is provided with a shut-off switch to facilitate the interrupting of a buzzing effect of the alarm clock.

4. The alarm clock as defined in claim 1, wherein said housing is provided therein with a recess for accommodating a plurality of decorative objects.

5. The alarm clock as defined in claim 4, wherein said decorative objects are toys.

6. The alarm clock as defined in claim 1, wherein said housing is composed of a front housing and a rear housing, said front housing containing the alarm clock main body, the speaker, and the control circuit, said rear housing provided with a battery cell for containing the battery set.

* * * * *